US011094458B2

(12) United States Patent
Bong et al.

(10) Patent No.: US 11,094,458 B2
(45) Date of Patent: Aug. 17, 2021

(54) COIL COMPONENT AND METHOD FOR MANUFACTURING THE SAME

(71) Applicant: SAMSUNG ELECTRO-MECHANICS CO., LTD., Suwon-si (KR)

(72) Inventors: Kang Wook Bong, Suwon-si (KR); Byeong Cheol Moon, Suwon-si (KR); Boum Seock Kim, Suwon-si (KR); Jin Hyuk Jang, Suwon-si (KR); Joung Gul Ryu, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 303 days.

(21) Appl. No.: 15/828,091

(22) Filed: Nov. 30, 2017

(65) Prior Publication Data

US 2019/0006100 A1 Jan. 3, 2019

(30) Foreign Application Priority Data

Jun. 28, 2017 (KR) ..... 10-2017-0081569

(51) Int. Cl.
*H01F 27/29* (2006.01)
*H01F 41/04* (2006.01)
(Continued)

(52) U.S. Cl.
CPC ..... *H01F 41/042* (2013.01); *H01F 17/0006* (2013.01); *H01F 17/0013* (2013.01);
(Continued)

(58) Field of Classification Search
CPC ..... H01F 27/2804; H01F 27/28; H01F 2017/002; H01F 5/003; H01F 17/0006;
(Continued)

(56) References Cited

U.S. PATENT DOCUMENTS 9,236,171 B2 * 1/2016 Ito ..... H01F 17/04
10,217,563 B2 2/2019 Wang et al.
(Continued)

FOREIGN PATENT DOCUMENTS

CN 101283417 A 10/2008
CN 103180919 A 6/2013
(Continued)

OTHER PUBLICATIONS

Korean Office Action dated Jul. 10, 2018 issued in Korean Patent Application No. 10-2017-0081569 (with English translation).
(Continued)

*Primary Examiner* — Alexander Talpalatski
*Assistant Examiner* — Joselito S. Baisa
(74) *Attorney, Agent, or Firm* — Morgan, Lewis & Bockius LLP

(57) ABSTRACT

A coil component includes a magnetic body and an external electrode disposed on an external surface of the magnetic body. The magnetic body includes a support member including a through hole, filled with a magnetic material, and a via hole, a coil disposed on at least one surface of the support member, and a magnetic material encapsulating the coil and the support member. A first conductive layer is disposed on a side surface of the via hole formed in the support member and the at least one surface of the support member. The via hole is filled with a portion of the second conductive layer disposed on the first conductive layer.

8 Claims, 7 Drawing Sheets

(51) Int. Cl.
*H01F 17/00* (2006.01)
*H01F 27/28* (2006.01)
*H01F 27/255* (2006.01)
*H01F 17/04* (2006.01)

(52) U.S. Cl.
CPC ..... *H01F 27/255* (2013.01); *H01F 27/2804* (2013.01); *H01F 27/29* (2013.01); *H01F 27/292* (2013.01); *H01F 41/046* (2013.01); *H01F 41/043* (2013.01); *H01F 2017/002* (2013.01); *H01F 2017/0066* (2013.01); *H01F 2017/048* (2013.01)

(58) Field of Classification Search
CPC ..... H01F 27/29; H01F 27/255; H01F 27/292; H01F 27/25; H01F 17/0013; H01F 2027/2809
USPC ..... 336/192
See application file for complete search history.

(56) References Cited

U.S. PATENT DOCUMENTS

| | | | | |
|---|---|---|---|---|
| 10,319,515 | B2 * | 6/2019 | Jung | H01F 41/042 |
| 10,431,368 | B2 * | 10/2019 | Choi | H01F 27/2804 |
| 10,614,943 | B2 * | 4/2020 | Choi | H01F 27/255 |
| 10,640,879 | B2 * | 5/2020 | Riemer | C25D 7/00 |
| 2004/0164835 | A1 * | 8/2004 | Shoji | H01F 17/0013 336/200 |
| 2008/0050616 | A1 | 2/2008 | Lee et al. | |
| 2009/0128275 | A1 | 5/2009 | Yagasaki et al. | |
| 2009/0153282 | A1 * | 6/2009 | Taoka | H01F 17/0013 336/200 |
| 2013/0082812 | A1 | 4/2013 | Yoo et al. | |
| 2013/0222101 | A1 | 8/2013 | Ito et al. | |
| 2015/0035640 | A1 * | 2/2015 | Wang | H01F 17/0006 336/200 |
| 2015/0048918 | A1 | 2/2015 | Park et al. | |
| 2015/0091688 | A1 * | 4/2015 | Jung | H01F 17/0006 336/200 |
| 2016/0005527 | A1 * | 1/2016 | Park | C25D 7/00 336/200 |
| 2016/0111193 | A1 * | 4/2016 | Jeong | H01F 17/06 336/200 |
| 2016/0343500 | A1 * | 11/2016 | Jung | H01F 27/292 |
| 2017/0032884 | A1 | 2/2017 | Choi et al. | |
| 2017/0140866 | A1 * | 5/2017 | Hong | H01F 27/245 |
| 2017/0150608 | A1 * | 5/2017 | Yoon | H01F 41/0206 |
| 2019/0279807 | A1 * | 9/2019 | Ryu | H01F 27/29 |
| 2019/0295763 | A1 * | 9/2019 | Cho | H01F 27/323 |

FOREIGN PATENT DOCUMENTS

| | | | |
|---|---|---|---|
| CN | 106169353 | A | 11/2016 |
| CN | 106252037 | A | 12/2016 |
| CN | 106409469 | A | 2/2017 |
| EP | 1 916 678 | A1 | 4/2008 |
| JP | 5084459 | B2 | 11/2012 |
| KR | 2008-0017804 | A | 2/2008 |
| KR | 10-2013-0035474 | A | 4/2013 |
| KR | 10-2015-0019588 | A | 2/2015 |
| KR | 10-2017-0058006 | A | 5/2017 |
| KR | 10-2017-0067165 | A | 6/2017 |
| KR | 2016-0034802 | A | 3/2018 |

OTHER PUBLICATIONS

Office Action issued in corresponding Chinese Patent Application No. 201810044710.2 dated Jul. 28, 2020, with English translation.

* cited by examiner

COIL COMPONENT AND METHOD FOR MANUFACTURING THE SAME

CROSS-REFERENCE TO RELATED APPLICATION

This application is based on and claims the benefit of priority to Korean Patent Application No. 10-2017-0081569, filed on Jun. 28, 2017 with the Korean Intellectual Property Office, the entire disclosure of which is incorporated herein by reference.

TECHNICAL FIELD

The present disclosure relates to a coil component and a method for manufacturing the same, and more particularly, to a thin film type power inductor and a method for manufacturing the same.

BACKGROUND

Due to the trend for high performance in mobile devices, such as smartphones and tablet personal computers (PCs), the speeds of application processors (APs) have been increased, while displays have become larger, and the amount of power consumed to operate dual- or quad-core APs has increased. Thus, thin film type inductors principally used in direct current-direct current (DC-DC) converters or in noise filters may be required to have a high inductance and a low direct current resistance (Rdc). Furthermore, as information technology (IT) technology advances, the miniaturization and thinning of various electronic devices are accelerating, and accordingly, thin film type inductors used in electronic devices are also required to be thinned. The tendency to decrease the width of coils and increase the height thereof is required to be maintained to increase the aspect ratio of coils in miniaturizing thin film type inductors. In this regard, the issue of vias connecting coils is further highlighted.

SUMMARY

An aspect of the present disclosure may provide a coil component that may increase reliability of a coil having a high aspect ratio by improving a connection structure of an upper coil and a lower coil, while simplifying a manufacturing process, and a method for manufacturing the coil component.

According to an aspect of the present disclosure, a coil component may include: a magnetic body forming an exterior of the coil component; and an external electrode disposed on an external surface of the magnetic body. The magnetic body may include: a support member including a through hole, filled with a magnetic material, and a via hole; a coil disposed on at least one surface of the support member; and a magnetic material encapsulating the support member and the coil. The coil may include a first conductive layer and a second conductive layer disposed on the first conductive layer. The first conductive layer may be continuously disposed on a side surface of the via hole formed in the support member and the at least one surface of the support member. The second conductive layer may include a central plating layer disposed inside the via hole, and a coil layer disposed above or below the central plating layer. The central plating layer may be integrally formed with the coil layer to be a single structure.

According to another aspect of the present disclosure, a method for manufacturing a coil component may include: providing a support member; forming a via hole in the support member; when there is a conductive material layer on at least one surface of the support member, removing the conductive material layer; forming a first conductive layer on the at least one surface of the support member and a side surface of the via hole; forming an insulating pattern on an exposed surface of the first conductive layer, the insulating pattern having a plurality of openings in a thickness direction of the support member; forming a second conductive layer by filling the openings with a conductive material; removing the insulating pattern; forming a magnetic body using a magnetic material, the magnetic material encapsulating the second conductive layer and the support member; and forming an external electrode on an external surface of the magnetic body, the external electrode being connected to the second conductive layer.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
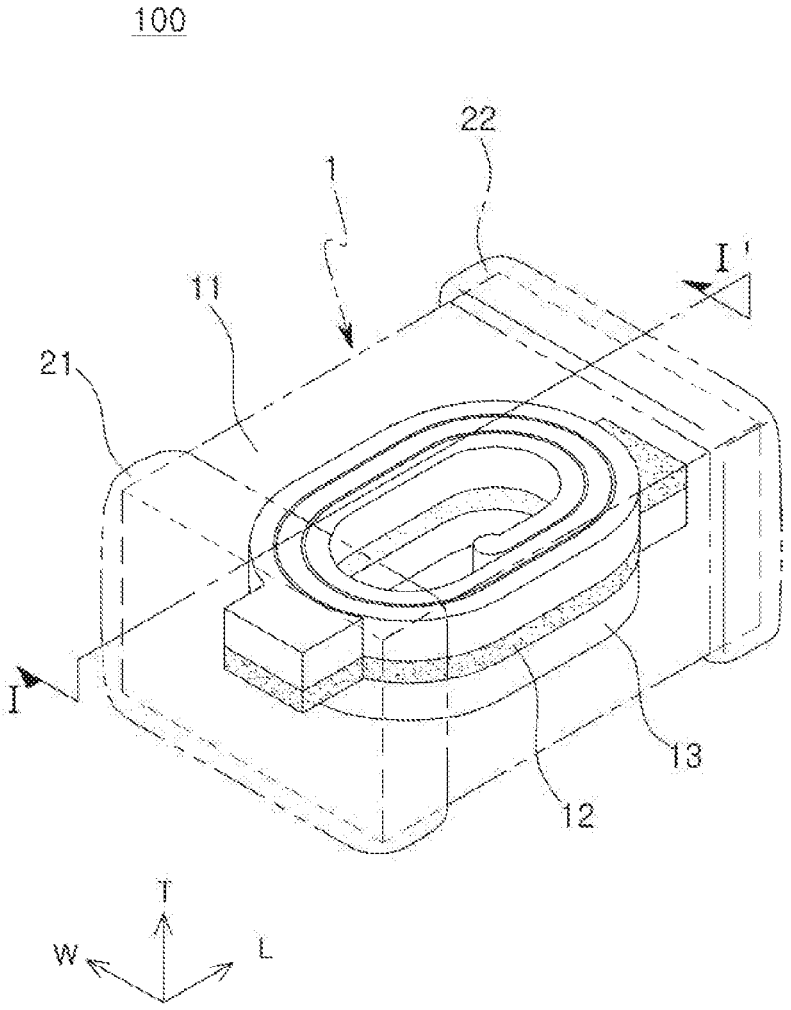
FIG. 1 is a schematic cross-sectional view of a coil component, according to an exemplary embodiment.

Hereinafter, embodiments of the present disclosure will be described with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element, or other elements intervening therebetween may be present. In contrast, when an element is referred to as being "directly on," "directly connected to," or "directly coupled to" another element, there may be no other elements or layers intervening therebetween. Like numerals refer to like elements throughout. As used herein, the term "and/or" includes any and all combinations of one or more of the associated, listed items.

It will be apparent that, although the terms 'first,' 'second,' 'third,' etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" or the like, may be used herein for ease of description to describe one element's relationship relative to another element(s), as shown in the figures. It will be understood that spatially relative terms are intended to encompass different orientations of the device in use or operation, in addition to the orientation depicted in the figures. For example, if the device in the figures is turned over, elements described as "above," or "upper" relative to other elements would then be oriented "below," or "lower" relative to the other elements or features. Thus, the term "above" can encompass both the above and below orientations, depending on a particular directional orientation of the figures. The device may be otherwise oriented (rotated 90 degrees or at other orientations) and the spatially relative descriptors used herein may be interpreted accordingly.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views illustrating embodiments of the present disclosure. In the drawings, for example, due to manufacturing techniques and/or tolerances, modifications of the shape shown may be estimated. Thus, embodiments of the present disclosure should not be construed as being limited to the particular shapes of regions shown herein, for example, to include a change in shape resulting from manufacturing. The following embodiments may also be constituted alone or as a combination of several or all thereof.

The contents of the present disclosure described below may have a variety of configurations, and only a required configuration is proposed herein, but the present disclosure is not limited thereto.

Hereinafter, a coil component, according to an exemplary embodiment, and a method for fabricating the same are described. However, the present disclosure is not limited thereto.

Coil Component

FIG. 1 is a schematic perspective view of a coil component 100, according to an exemplary embodiment of the present disclosure. Referring to FIG. 1, the coil component 100 may include a magnetic body 1, and a first external electrode 21 and a second external electrode 22 disposed on an external surface of the magnetic body 1.

The magnetic body 1 may form an overall exterior of the coil component 100, may have an upper surface and a lower surface opposing each other in a thickness direction T, a first end surface and a second end surface opposing each other in a length direction L, and a first side surface and a second side surface opposing each other in a width direction W, and may have a substantially hexahedral shape. However, the present disclosure is not limited thereto.

The magnetic body 1 may include a magnetic material 11, having magnetic properties. For example, the magnetic material may be formed by incorporating ferrite or magnetic metallic particles in a resin. The magnetic metallic particles may include, for example, at least one selected from the group consisting of iron (Fe), silicon (Si), chromium (Cr), aluminum (Al), and nickel (Ni).

In addition to the magnetic material 11, the magnetic body 1 may include a support member 12 and a coil 13 encapsulated with the magnetic material 11.

The first and second external electrodes 21 and 22 disposed on external surfaces of the magnetic body 1 may be connected to lead portions of the coil 13 disposed in the magnetic body 1. FIG. 1 illustrates the first and second external electrodes 21 and 22, each having a "C" shape, but a detailed structure and shape of the first and second external electrodes 21 and 22 are not particularly limited thereto. For example, each of the first and second external electrodes 21 and 22 may have an "L" shape that does not extend onto the upper surface of the magnetic body 1, or may be a lower electrode that is only disposed on the lower surface of the magnetic body 1.

The first and second external electrodes 21 and 22 may be formed of, for example, a material having improved electrical conductivity, such as nickel (Ni), copper (Cu), silver (Ag), or alloys thereof, and may be also formed in a plurality of layers. In some cases, each of the first and second external electrodes 21 and 22 may be formed by forming a wiring plated with copper (Cu) in an innermost portion thereof and then disposing a plurality of plating layers on the wiring. However, a material and a formation method of the first and second external electrodes 21 and 22 are not limited thereto.

Figure 2:
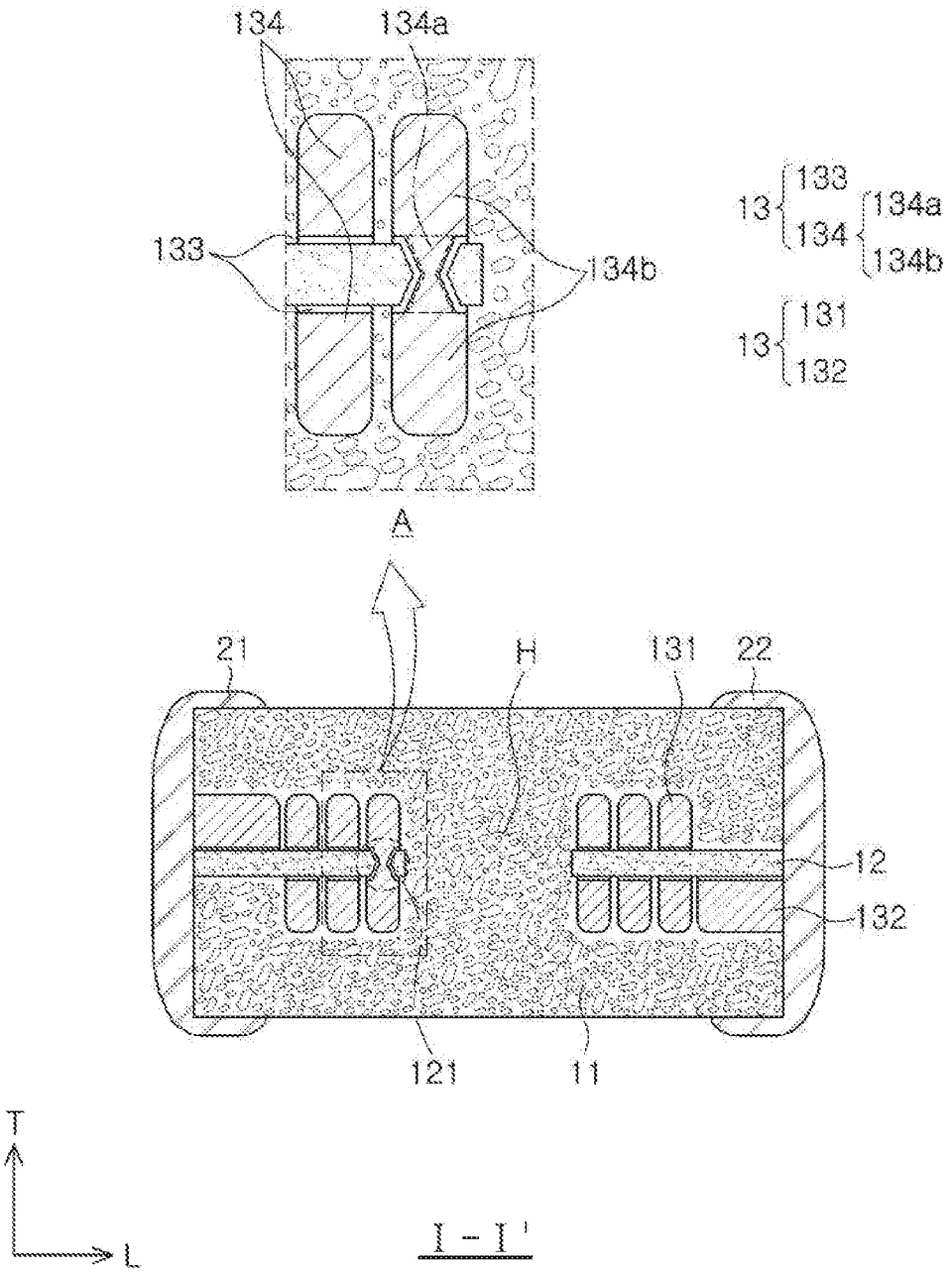
FIG. 2 is a schematic cross-sectional view taken along line I-I' of FIG. 1.

FIG. 2 is a schematic cross-sectional view taken along line I-I' of FIG. 1. Structures of the coil 13 and the support member 12 disposed in the magnetic body 1 are described in FIG. 2 in more detail.

Referring to FIG. 2, the support member 12 may have a thin plate shape that supports the coil 13, so the coil 13 can be formed in a further reduced thickness more easily. The support member 12 may be an insulating substrate formed of an insulating resin. The insulating resin may be, for example, a thermosetting resin such as an epoxy resin, a thermoplastic resin such as a polyimid, or a resin in which a stiffener such as a glass fiber or an inorganic filler is impregnated such as a prepreg (PPG), an Ajinomoto build-up film (ABF), a FR-4 resin, a bismaleimide triazine (BT) resin, or a photoimageable dielectric (PID) resin. When the support member 12 includes a glass fiber, rigidity of the support member 12 may be further improved.

The support member 12 may include a through hole H, filled with the magnetic material 11, and a via hole 121 that may be spaced apart from the through hole H and may form a via that connects an upper coil 131 supported by an upper surface of the support member 12 to a lower coil 132 supported by a lower surface of the support member 12. The via hole 121 may be filled with a conductive material to form a component of the coil 13.

A cross section of the via hole 121 may have a tapered shape whose width becomes narrow toward a center of the support member 12 in the thickness direction T, and may have a structure generally similar to that of a sandglass. However, the present disclosure is not limited thereto. For example, a side surface of the via hole 121 may be formed to be curved, and due to the cross section of the via hole 121 having a rectangular shape, the via hole 121 may have generally the same width.

Further, the coil 13 supported by the support member 12 may be divided into the upper coil 131 and the lower coil 132 disposed on the upper surface and the lower surface of the support member 12, respectively, as mentioned above.

The upper and lower coils 131 and 132 may be connected to each other by the conductive material filled in the via hole 121. The coil 13 may also be divided into a first conductive layer 133 and a second conductive layer 134, with respect to an interface therebetween.

Referring to FIG. 2, the first conductive layer 133 may be disposed below the second conductive layer 134 to substantially function as a seed pattern of the second conductive layer 134 that determines an aspect ratio of the coil 13.

Region A indicated by dotted line in FIG. 2 may include a region in which the via hole 121 of the support member 12 is formed. Referring to Region A, the first conductive layer 133 may be continuously disposed on a side surface of the via hole 121 and on portions of the upper and lower surfaces of the support member 12 extending from the side surface of the via hole 121. Further, portions of the first conductive layer 133 may be disposed on the upper and lower surfaces of the support member 12, respectively, to have a shape in which the coil 13 is wound. In region A, an average thickness of the portions of the first conductive layer 133 disposed on the upper and lower surfaces of the support member 12 may be substantially the same as an average thickness of portions of the first conductive layer 133 disposed on the side surface of the via hole 121. A difference between the average thicknesses may be 500 nm or less. Further, a total average thickness of the first conductive layer may be 1 μm or less. The first conductive layer 133 may include a material having improved electrical conductivity and may be different from a material of the second conductive layer 134. For example, the first conductive layer 133 may include at least one of aluminum (Al), titanium (Ti), nickel (Ni), and tungsten (W).

A method for forming the first conductive layer 133 is not particularly limited thereto.

In Region A, the second conductive layer 134 may be disposed on the first conductive layer 133 to be overlapped with the first conductive layer 133, and may substantially fill the via hole 121. A portion of the second conductive layer 134 filling the via hole 121 refers to a central plating layer 134*a*, and another portion of the second conductive layer 134, except for the central plating layer 134*a*, in Region A, may refer to a coil layer 134*b*. The coil layer 134*b* of the second conductive layer 134 may be divided into an upper coil layer disposed above the central plating layer 134*a* and a lower coil layer disposed below the central plating layer 134*a*, with respect to the central plating layer 134*a*. However, the central plating layer 134*a* may be integrally formed with the upper coil layer and/or the lower coil layer, and there may be no interface between the central plating layer 134*a* and the upper coil layer or the lower coil layer of the coil layer 134*b*. As a result, a likelihood of poor bonding that may occur due to heterogeneous materials, different manufacturing conditions, or the like of the central plating layer 134*a*, the upper coil layer, and the lower coil layer may be completely removed. In this regard, a boundary line between the central plating layer 134*a* and the upper coil layer or the lower coil layer of the coil layer 134*b*, indicated by a dotted line in Region A of FIG. 2, is provided simply for convenience of description, and the dotted line does not mean that an actual boundary line is present therebetween.

In terms of shapes of the first and second conductive layers 133 and 134 in Region A, a width of the first conductive layer 133 may be substantially the same as that of the second conductive layer 134 disposed thereon. Accordingly, the aspect ratio of the coil 13 including the first and second conductive layers 133 and 134 may be significantly increased. In general, as a coil is formed higher, plating variations may be increased, and the shape of the coil may not be uniformly controlled, so that there may be limitations in increasing an aspect ratio of the coil. However, the first and second conductive layers 133 and 134 may be grown in the thickness direction T, while maintaining a substantially constant width. Thus, the aspect ratio of the coil 13 of the coil component 100, according to an exemplary embodiment, may be freely controlled, if desired. For example, the coil 13 including the first and second conductive layers 133 and 134 may be grown to have a height of about 100 μm or greater. As described below, when the second conductive layer 134 includes a plurality of conductive layers, having an interface therebetween, a higher aspect ratio of the coil 13 may further be achieved.

Figure 3:
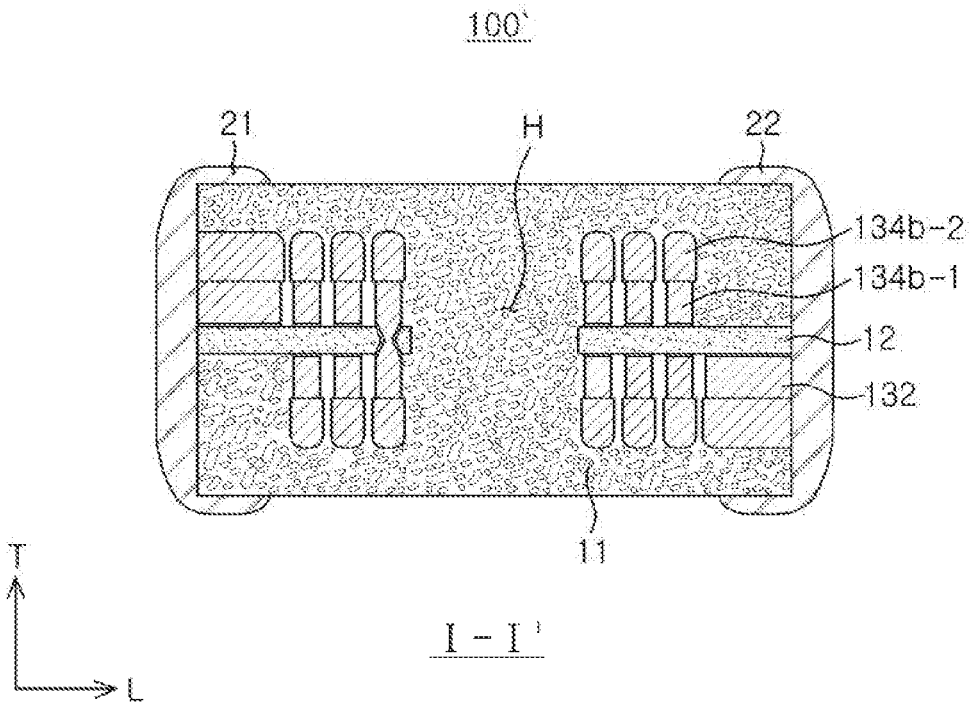
FIG. 3 is a schematic cross-sectional view of a modification of FIG. 2.

FIG. 3 illustrates a case in which the second conductive layer 134 of the coil component 100 of FIG. 2 may include a plurality of conductive layers having interfaces therebetween as another exemplary embodiment of FIG. 2. For convenience of description, the same reference denotations may be used for configurations overlapping those in FIG. 2, and repeated descriptions are omitted.

Referring to FIG. 3, the coil layer 134*b* of the second conductive layer 134 disposed in a coil component 100' may include a plurality of layers of different widths. The dotted line in FIG. 3 represents an interface between the plurality of layers (e.g., two layers) of the coil layer 134*b*, and the plurality of layers may be formed by disposing insulating patterns at least twice and filling openings between the insulating patterns with a conductive layer through a plating process. In an exemplary embodiment, when the coil layer 134*b* has two coil layers, a lower layer 134*b*-1 of the two coil layers may be formed through an isotropic plating process, while an upper layer 134*b*-2 of the two coil layers may be formed through an anisotropic plating process. However, the present disclosure is not limited thereto. Further, a width of the lower layer 134*b*-1 of the two coil layers may be less than that of the upper layer 134*b*-2 of the two coil layers. This is because an opening between lower insulating patterns forming the lower layer 134*b*-1 of the two coil layers is narrower than an opening between upper insulating patterns forming the upper layer 134*b*-2 of the two coil layers. This may ensure an alignment between the upper insulating patterns and the lower insulating patterns.

Figure 4:
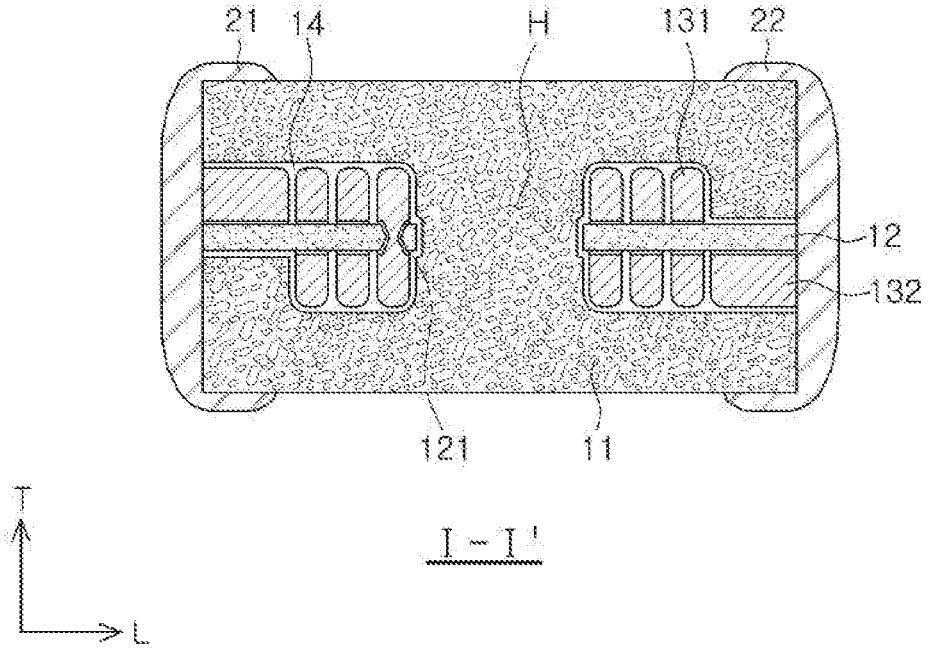
FIG. 4 is a schematic cross-sectional view of another modification of FIG. 2.

FIG. 4 illustrates a schematic cross-sectional view of a coil component in which an additional insulating film 14 is formed on the outer surface of the coil 13 included in the coil component 100 of FIG. 2. For convenience of description, the same reference denotations may be used for configurations overlapping those in FIG. 2, and repeated descriptions are omitted.

Referring to FIG. 4, the insulating film 14 may be disposed on a contact surface between the coil 13 and the magnetic material 11. It may be sufficient that the insulating film 14 have any material or structure that may ensure insulating properties of the coil 13. The material or structure of the insulating film 14 is not particularly limited thereto. For example, the insulating film 14 may be formed by coating a parylene resin through a chemical vapor deposition (CVD) process. As a result, the insulating film 14 may be uniformly formed to have an average thickness of 1 μm or less. Although not illustrated specifically in FIG. 2, the coil 13 may be required to be insulated from the magnetic material 11. Thus, the coil 13 may inevitably include an insulating configuration, and insulating properties of the coil 13 may be ensured using a method properly selected by a person of ordinary skill in the art.

Method for Manufacturing Coil Component

An example of a method for manufacturing a coil component, according to another exemplary embodiment, is described in FIGS. 5A to 5K. For convenience of description, the same reference denotations may be used for components overlapping those described above in FIGS. 1 and 2.

Figure 5A:
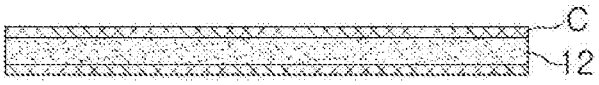
FIGS. 5A through 5K are schematic cross-sectional views of a method for manufacturing a coil component, according to another exemplary embodiment.

FIG. 5A illustrates providing the support member 12. For example, a copper clad laminate (CCL) may be used as the support member 12. However, a material of the support member 12 is not limited thereto. An ABF or the like, having no copper foil stacked on upper and lower surfaces thereof, may also be used.

Figure 5B:
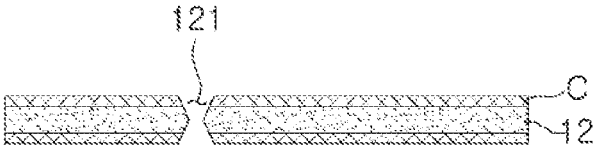

FIG. 5B illustrates forming the via hole 121 in the support member 12. The forming of the via hole 121 may include forming a vertical hole using an ultraviolet (UV) laser. The via hole 121 may be provided to electrically connect the upper coil 131 and the lower coil 132 to be formed later, and a diameter and the number of the via holes 121 may be properly selected by a person of ordinary skill in the art.

Figure 5C:
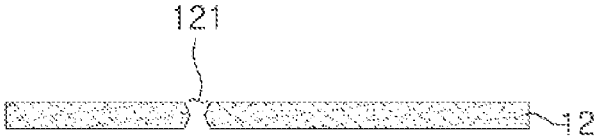

FIG. 5C illustrates removing copper (Cu) foil layers C from the upper and lower surfaces of the support member 12. In some cases, when the support member 12 is only formed of an insulating resin and there is no additional conductive material layer on the upper and lower surfaces of the support member 12, the removing of the Cu foil layers C in FIG. 5C may be omitted. A method for removing the Cu foil layers C, such as a laser radiating method or a chemical etching method, may be properly selected by a person of ordinary skill in the art, and is not particularly limited thereto.

Figure 5D:
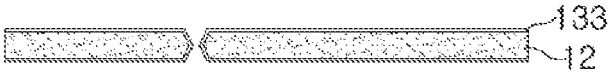

FIG. 5D illustrates forming the first conductive layer 133 continuously coating all of the side surface of the via hole 121 and the upper and lower surfaces of the support member 12. For example, a sputtering method may be adopted for the forming of the first conductive layer 133. This is because the sputtering method may have a high degree of freedom for material selection and may form a considerably thin and uniformly thin film layer. Further, the first conductive layer 133 may simultaneously coat the side surface of the via hole 121 and at least one surface of the support member 12. This is because it may not be easy to form a uniform thin film layer, due to an overcoating of the first conductive layer 133 on a region, such as the side surface of the via hole 121, the upper surface of the support member 12, or an edge of the support member 12 connecting the side surface to the upper surface. The thickness of the first conductive layer 133 may be, for example, about 1 μm or less, but is not particularly limited thereto.

Figure 5E:
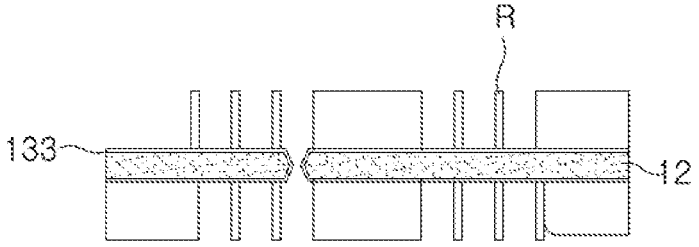

FIG. 5E illustrates forming insulating patterns R, having a plurality of openings, on the first conductive layer 133 illustrated in FIG. 5D. In an exemplary embodiment, because the aspect ratio of the coil 13 is determined according to a ratio of a height to a width of the openings, the width of the openings may be, for example, significantly less. However, the width of the openings is not particularly limited thereto. The openings may be formed through the via hole 121 of the support member 12, such that the upper and lower coil layers of the second conductive layer 134 substantially stacked on the first conductive layer 133 may be conducted to each other.

A material of the insulating patterns R may be, for example, a resin, having improved insulation and processability properties. The insulating patterns R may be a photoresist pattern formed by exposing a photoresist to light and developing the exposed photoresist.

Figure 5F:
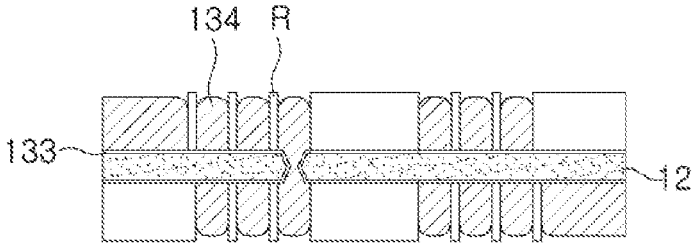

FIG. 5F illustrates forming the second conductive layer 134 by filling the openings between the insulating patterns R. The forming of the second conductive layer 134 may be a common Copper (Cu) plating process. However, the present disclosure is not limited thereto.

When the second conductive layer 134 fills the openings between the insulating patterns R, the second conductive layer 134 may be filled in the openings, for example, to a level of an upper surface of the second conductive layer 134 that is lower than a level of upper surfaces of the insulating patterns R adjacent to the second conductive layer 134. The reason is that, when the second conductive layer 134 is filled in the openings to a level higher than the level of the upper surfaces of the insulating patterns R, a short circuit may occur between adjacent portions of the second conductive layer 134.

Figure 5G:
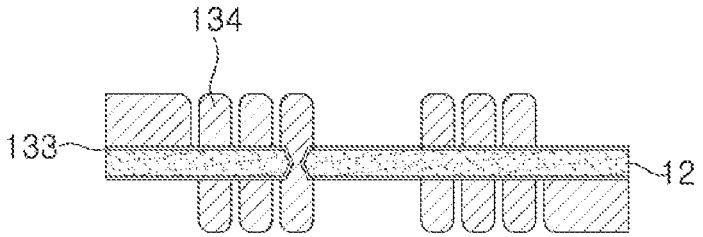

FIG. 5G illustrates etching the insulating patterns R illustrated in FIG. 5E. A method for etching the insulating patterns R, such as a laser etching method, a chemical etching method, or the like, may be selectively adopted, and may be properly selected, according to a material and a thickness of the insulating patterns R.

Figure 5H:
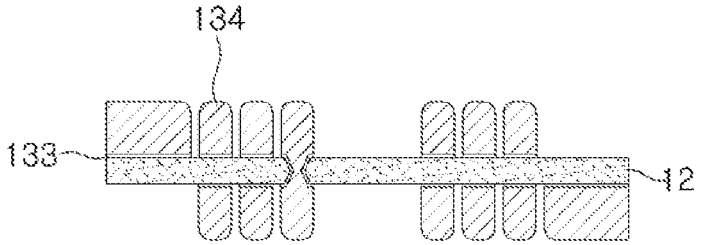

FIG. 5H illustrates removing the insulating patterns R and then removing portions of the first conductive layer 133. The portions of the first conductive layer 133 exposed by removing the insulating patterns R may be removed. Other portions of the first conductive layer 133 disposed on a lower surface of the second conductive layer 134 may not be externally exposed subsequently by removing the insulating patterns R. Thus, the other portions of the first conductive layer 133 may be left in the coil component.

Figure 5I:
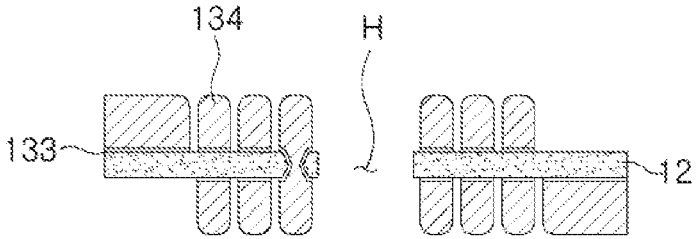

FIG. 5I illustrates forming the through hole H for increasing permeability subsequently to the forming of the overall shape of the coil 13. A detailed method for forming the through hole H may be properly selected by a person of ordinary skill in the art. For example, a mechanical drilling method or a laser drilling method may be used.

Figure 5J:
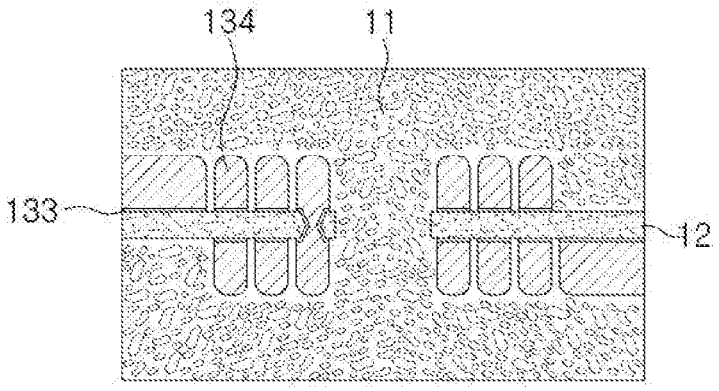

FIG. 5J illustrates encapsulating the coil 13 and the support member 12 with the magnetic material 11. For example, a method for stacking a magnetic sheet including a composite material formed of a resin and a magnetic material may be used to encapsulate the coil 13 and the support member 12 with the magnetic material 11. However, the present disclosure is not limited thereto. The magnetic sheet may fill the through hole H illustrated in FIG. 5I to increase permeability of a magnetic core.

Figure 5K:
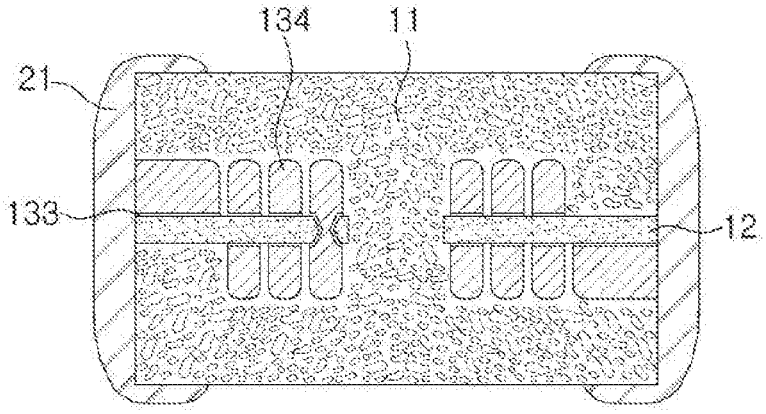

FIG. 5K illustrates forming the first and second external electrodes 21 and 22 to be electrically connected to the previously formed coil 13. Although not illustrated specifically, lead portions of the coil 13 may be externally exposed through a dicing process or the like so as to be electrically connected to the first and second external electrodes 21 and 22. It may be sufficient that the first and second external electrodes 21 and 22 be implemented to have improved electrical conductivity and a sufficient degree of adhesion with the coil 13. A method for forming the first and second external electrodes 21 and 22 is not particularly limited thereto.

As set forth above, according to an exemplary embodiment, there may be provided a coil component that may increase reliability of a coil having a high aspect ratio by improving a connection structure of an upper coil and a lower coil, while simplifying a manufacturing process, and a method for manufacturing the coil component.

While exemplary embodiments have been shown and described above, it will be apparent to those skilled in the art that modifications and variations could be made without departing from the scope of the present disclosure, as defined by the appended claims.

What is claimed is:

1. A coil component, comprising:

a magnetic body, the magnetic body including:

a support member including a through hole, filled with a magnetic material, and a via hole;

a coil disposed on first and second surfaces of the support member opposing each other, the coil including a first conductive layer and a second conductive layer disposed on the first conductive layer; and the magnetic material encapsulating the support member, the first conductive layer and the second conductive layer; and an external electrode disposed on an external surface of the magnetic body, the external electrode being connected to the coil, wherein the first conductive layer is continuously disposed on a side surface of the via hole and the first and second surfaces of the support member, a difference between an average thickness of a portion of the first conductive layer disposed on the first and second surfaces of the support member and an average thickness of another portion of the first conductive layer disposed on the side surface of the via hole is 500 nm or less, and a total average thickness of the first conductive layer is 1 μm or less, the second conductive layer includes a central plating layer disposed inside the via hole and a coil layer disposed above and below the central plating layer, the central plating layer is integrally formed with the coil layer to be a single structure, the second conductive layer includes a plurality of layers, the layers including a combination of an isotropic plating layer and an anisotropic plating layer, widths of portions of the isotropic and anisotropic plating layers are substantially constant, and a width of the isotropic plating layer is less than a width of the anisotropic plating layer.

2. The coil component of claim 1, wherein the central plating layer and the coil layer have no interface therebetween.

3. The coil component of claim 1, wherein a width of an upper surface of the first conductive layer disposed on the first and second surfaces of the support member is substantially the same as a width of a lower surface of the second conductive layer disposed on the first conductive layer.

4. The coil component of claim 1, wherein the first conductive layer includes at least one of aluminum (Al), titanium (Ti), nickel (Ni), and tungsten (W).

5. The coil component of claim 1, wherein an insulating film is further disposed on side surfaces of the first conductive layer and on side surfaces and upper or lower surfaces of the coil layer of the second conductive layer.

6. The coil component of claim 5, wherein the insulating film has an average thickness of 1 μm or less.

7. The coil component of claim 1, wherein a cross section of the via hole has a tapered shape whose width becomes narrow toward a center of the support member in a thickness direction.

8. The coil component of claim 1, wherein the coil layer of the second conductive layer includes a plurality of coil layers of different widths.

* * * * *